US006290661B1

(12) United States Patent
Cutler et al.

(10) Patent No.: US 6,290,661 B1
(45) Date of Patent: Sep. 18, 2001

(54) INFRARED CONTROL SYSTEM FOR A MASSAGE CHAIR

(75) Inventors: Stanley Cutler, Van Nuys, CA (US); Alton B. Otis, Jr., Port Townsend, WA (US); Taylor Chau, Cerritos, CA (US)

(73) Assignee: Inseat Solutions LLC, Costa Mesa, CA (US)

( * ) Notice: Subject to any disclaimer, the term of this patent is extended or adjusted under 35 U.S.C. 154(b) by 0 days.

(21) Appl. No.: 08/936,694

(22) Filed: Sep. 24, 1997

Related U.S. Application Data

(60) Provisional application No. 60/026,613, filed on Sep. 24, 1996, now abandoned.

(51) Int. Cl.[7] ..... A61H 23/02

(52) U.S. Cl. ..... 601/49; 601/57; 601/70

(58) Field of Search ..... 601/46, 48, 47, 601/56–60, 70, 86, 90, 93, 98, 101, 115; 341/176

(56) References Cited

U.S. PATENT DOCUMENTS 4,779,615 * 10/1988 Frazier ..... 128/33
5,304,112 * 4/1994 Mrklas et al. ..... 600/27

FOREIGN PATENT DOCUMENTS

2080001 * 1/1981 (DE) ..... 340/311.1

* cited by examiner

*Primary Examiner*—Danton D. DeMille
(74) *Attorney, Agent, or Firm*—Fulwider Patton Lee & Utecht, LLP

(57) ABSTRACT

A remote controlled massage device includes a remote control unit having a microprocessor, a keypad, and a transmitter, the microprocessor being programmed for generating output data directly corresponding to individual keystrokes of the keypad that define activation of particular vibrator elements, operation in particular time-variant power level sequences, relative vibration intensity, and relative speed of advancing through the time-variant power sequences. The transmitter has a transducer for radiating signals corresponding to the output data, for reflection from a ceiling under which the device is located, the data being transmitted in plural identical packets having a header, a sequence number, a device code program data, and an error code, subsequent sets of the identical packets having different sequence numbers. A massage unit of the device includes a cushion; electrically powered vibrator elements in the cushion; a detector supportable in an upwardly directed orientation relative to the cushion for receiving the reflected radiation signals; and a micro controller system electrically connected for driving the vibrator elements in a plurality of modes having variant power levels in response to the detector, the packets being validated using the error code and a settable device code of the massage unit, storing the sequence number of a last-received valid packet. Next-received valid packets having sequence numbers matching that of a last-received valid packet are ignored.

4 Claims, 9 Drawing Sheets

INFRARED CONTROL SYSTEM FOR A MASSAGE CHAIR

REFERENCE TO PROVISIONAL APPLICATION

This application claims the benefit of U.S. Provisional Application Ser. No. 60/026,613, filed Sep. 24, 1996, and being incorporated herein by this reference.

REFERENCE TO RELATED APPLICATION

This application claims the benefit of U.S. patent application Ser. No. 08/901,374, filed Jul. 28, 1996, and being incorporated herein by this reference.

REFERENCE TO APPENDIX

Attached hereto and incorporated herein is Appendix A (20 pages), which is a source code listing entitled "K5 CONTROL WAND CONTROL PROGRAM." Also attached hereto and incorporated herein is Appendix B (44 pages), which is a source code listing entitled "K5 SYSTEM CONTROL CONTROL PROGRAM." These assembly listings are subject to copyright protection. The copyright owner has no objection to the facsimile reproduction of the patent disclosure as it appears in the Patent and Trademark Office patent files or records, as otherwise authorized under applicable rules and procedures of the Office, but otherwise reserves all copyrights whatsoever.

BACKGROUND

The present invention relates to remote controlled massage systems, and more particularly to remote controlled massage chairs.

Thus there is a need for a remote controlled massage chair that overcomes the disadvantages of the prior art.

SUMMARY

The present invention meets this need by providing a remote controlled massage appliance that is particularly versatile regrading operation of a remote controller thereof. In one aspect of the invention, a massage device includes a remote control unit having a housing, a microprocessor, a keypad interfaced with the microprocessor, and a transmitter interfaced to the microprocessor for radiating output data signals being reflectable from a ceiling under which the appliance is located; and a massage unit having a cushion, vibrator elements in the cushion, an upwardly oriented detector for receiving the signals refelected from the ceiling, and a micro controller system for driving the vibrator elements in a plurality of modes having variant power levels in response to the detector.

The output data can directly correspond to individual keystrokes, which can include keystrokes defining activation of particular ones of the elements, time-variant power level sequences, vibration intensity, and the relative speed of advancing in the sequences. The micro controller system can have storage for a plurality of massaging programs, the output data including direct correspondence with varient power levels of a single selected program.

Preferably the output data is transmitted in plural identical packets, each including a header a sequence number, program data, and an error code that is used for validation, packets not validated being ignored. Further, packets having sequence numbers matching the last-received valid packet are also preferably ignored.

Preferably the packets include device code data that is matched with a corresponding device code of the massage unit for permitting reliable operation in close proximity with counterparts of the massage device.

DRAWINGS

These and other features, aspects, and advantages of the present invention will become better understood with reference to the following description, appended claims, and accompanying drawings, where:

DESCRIPTION

Figure 1:
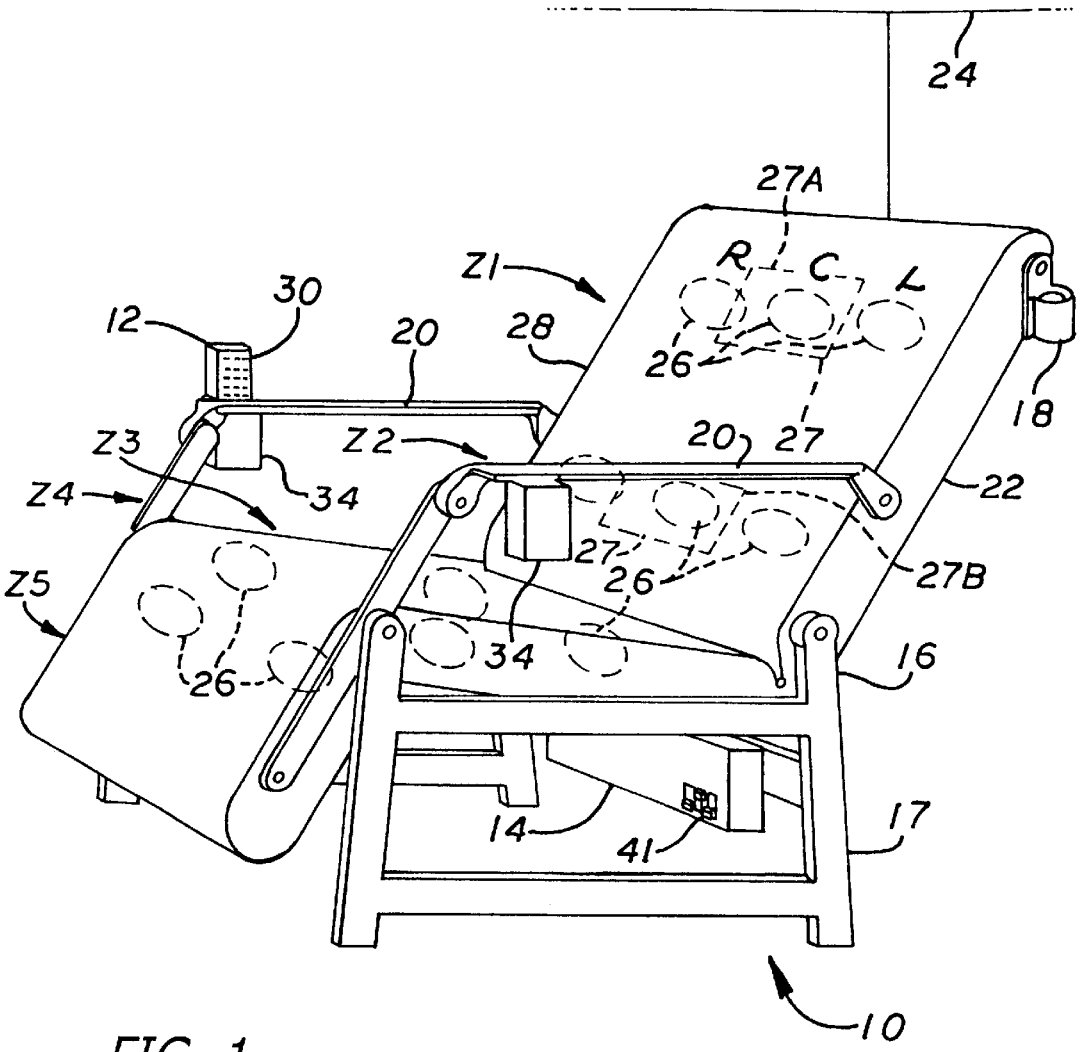
FIG. 1 is a pictorial diagrammatical view of a massage chair in an infrared remote control system according to the present invention.

The present invention is directed to a micro controller based remote control system for controlling the operation of a massage appliance such as a massage chair. With reference to FIGS. 1–4 of the drawings, a remote control system 10 has a remote control unit 12 for transmitting control signals to a micro controller unit 14 that is supported within an appliance such as a massage chair 16, which can be a recliner chair having a frame 17. In one embodiment of the invention, an Infra Red (IR) detector 18 is located on one of the chair's arms 20 or, as shown in FIG. 1, atop the chair's back 22, the detector 18 facing upwards to receive IR rays reflected from the ceiling 24 or other structures (not shown). As further shown in FIG. 1, an array of motor-driven vibrators 26 (also sometimes referred to as motors) are spaced within five zones (Z1–Z5) of a cushion 28 of the chair, individual ones of the motors 26 having the following designations:

Z1R, Z2R, Z3R, Z4R, Z5R

Z1C, Z2C

Z1L, Z2L, Z3L, Z4L, Z5L

Also located in the cushion 28 are a pair of heaters 27, one heater 27A for zone Z1C, the other heater 27B for zone Z2C.

A wand 30, preferably having a minimum of two IR LEDs 32 can be utilized as the remote controller 12. The wand 30 can be removably located at the top end of a wand case 34 near left and right corners of the chair 16, the IR LEDs 32 being set at optimum angles for enhancing a range of positioning of the wand 30 over which the control signals are detectable by the detector 18. Wand interaction with chair reception should operate reliably when held vertically in any combination ±45° degrees tilt fore and aft, and ±30° tilt left and right. When used with the detector 18 mounted (for example, as a pendulum) at the top of the chair back 22, the specified interface reliability applies regardless of the recliner chair back position.

Figures 1, 3:
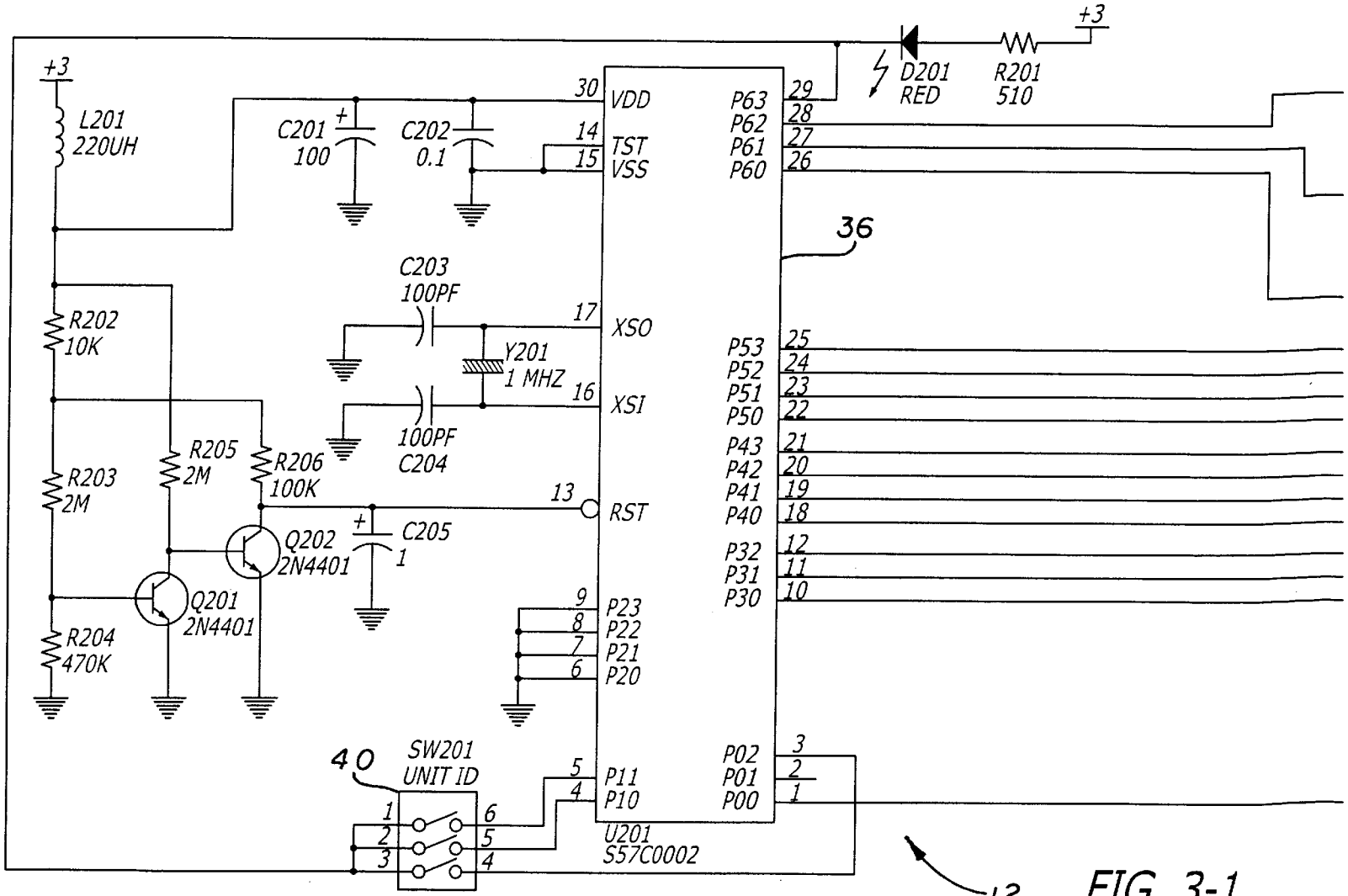
FIG. 3 is a schematic diagram of the remote controller unit of FIG. 2.
Figures 2, 3:
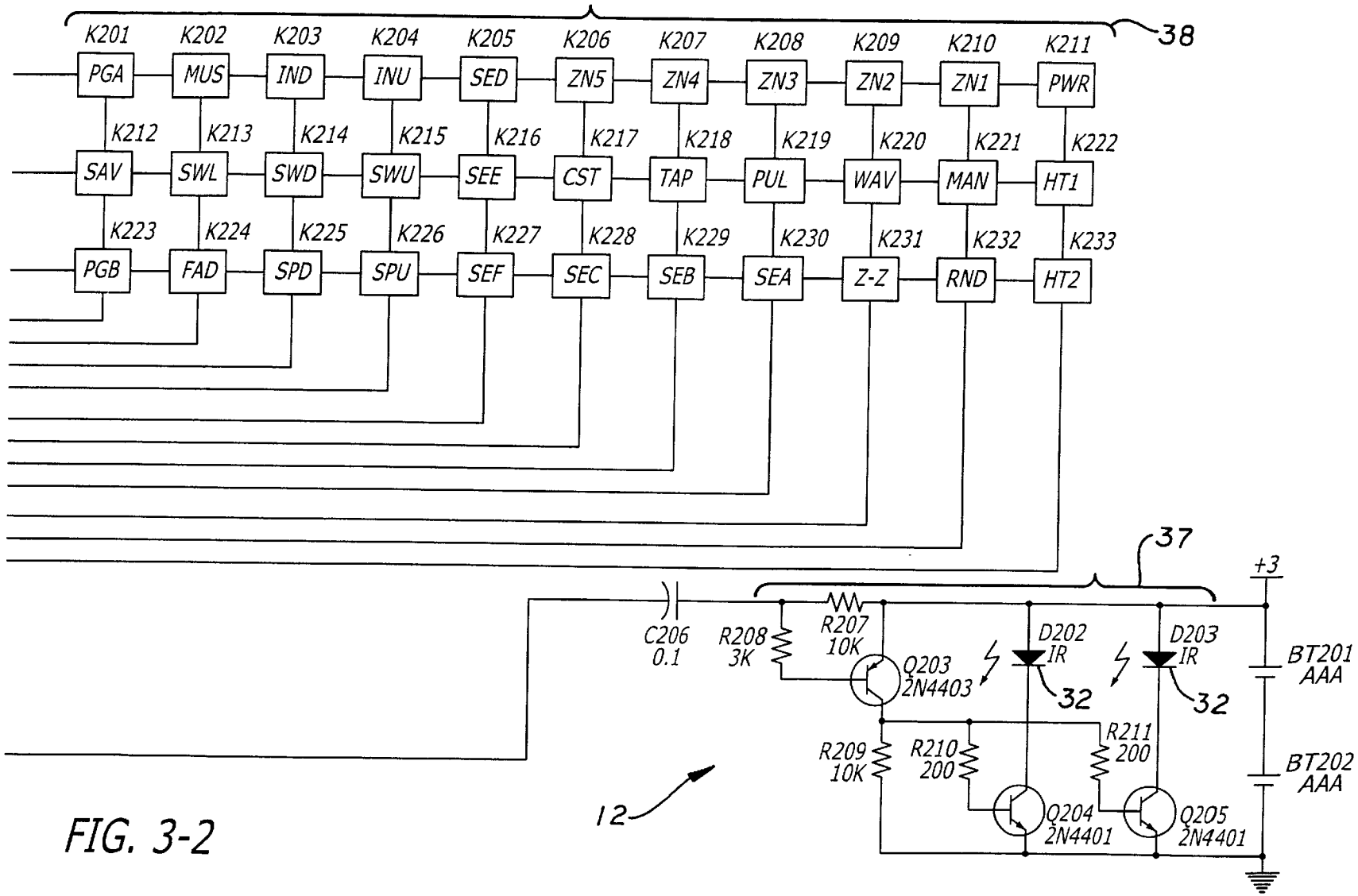
Figures 1, 4:
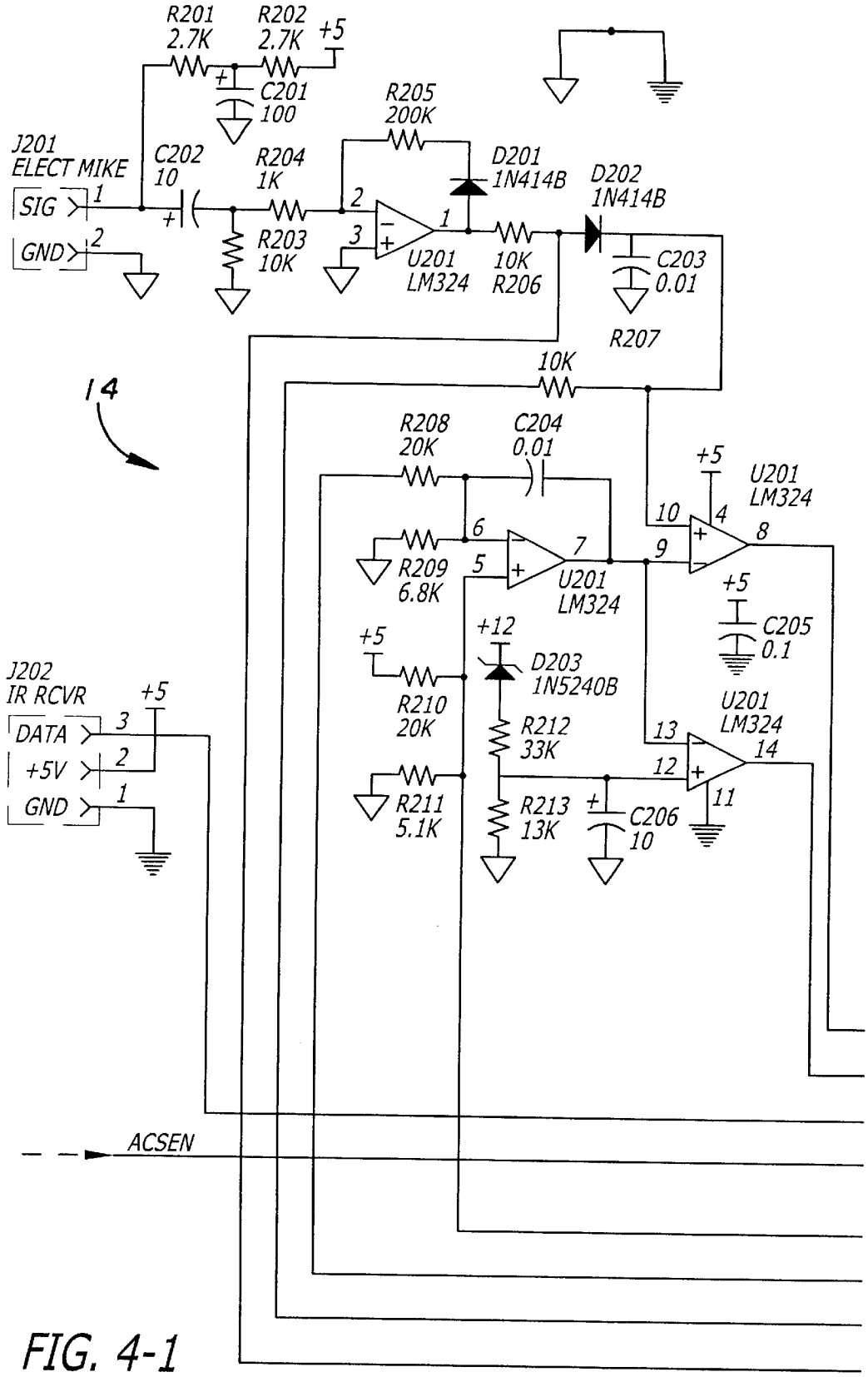
FIG. 4 is a schematic diagram of a receiver unit portion of the system of FIG. 1.
Figures 2, 4:
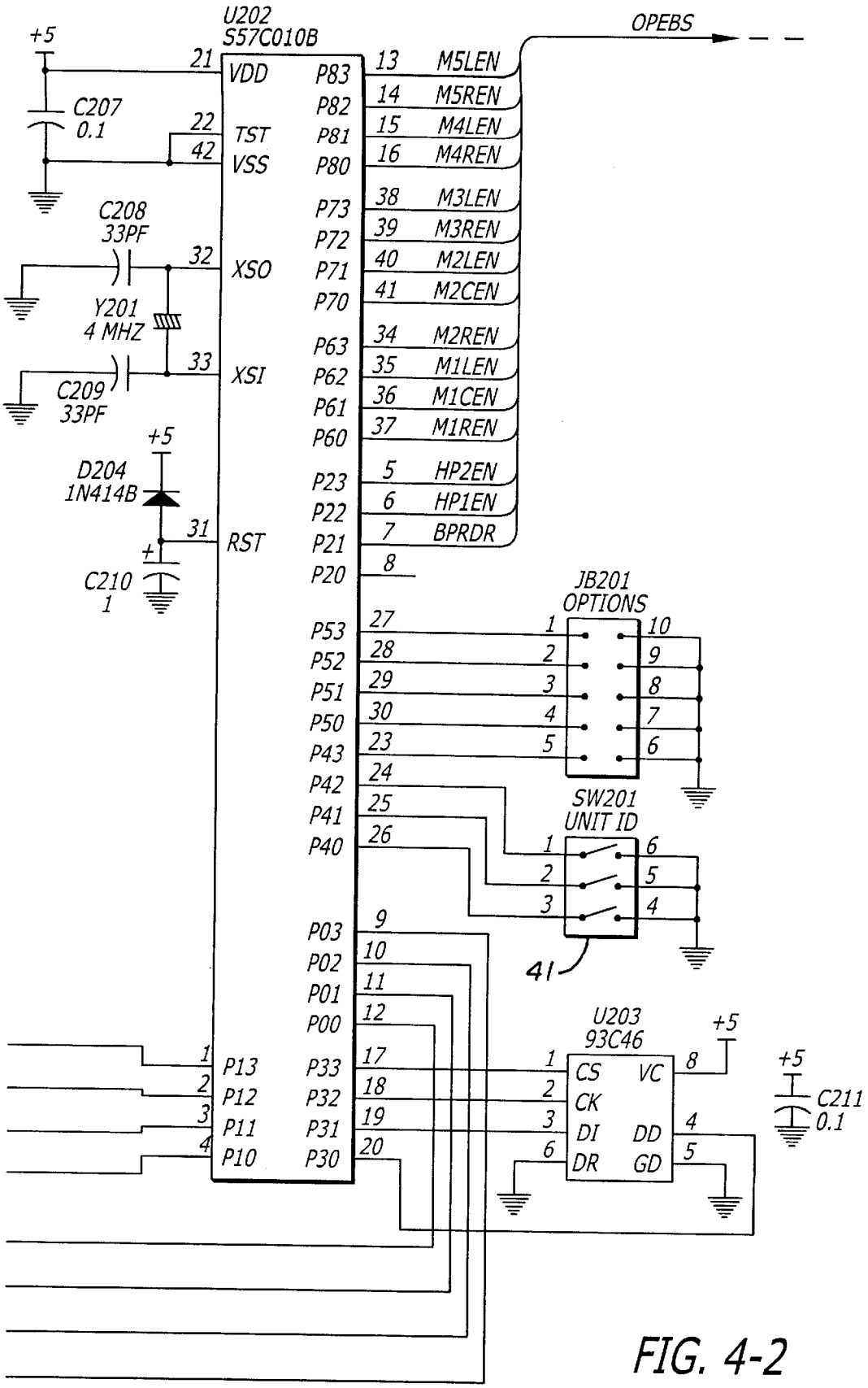

As further shown in FIG. 3, the remote control unit 12 includes a microprocessor 36 that includes non-volatile program memory and read/write memory for variable storage, the microprocessor 36 being interfaced with a transmitter circuit 37 for driving the LEDs 32, key matrix 38 for receipt of user input, and a device code switch 40, the switch 40 being further described below. A device suitable for use as the microprocessor 36 is commercially available as type S57C0002 from sources known to those having skill in the microcomputer art.

Figures 1, 5:
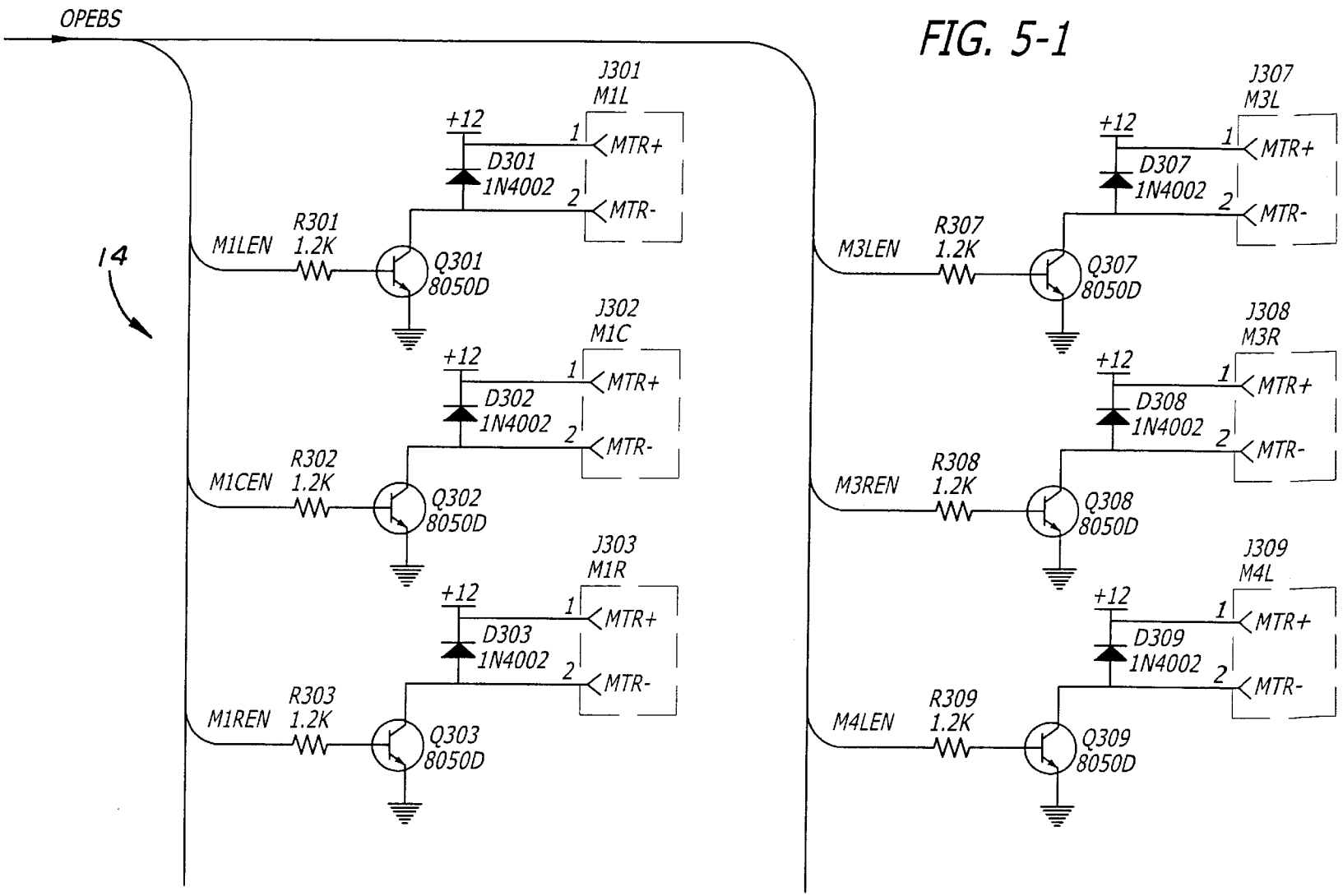
FIG. 5 is a schematic diagram of another receiver unit portion of the system of FIG. 1.
Figures 2, 5:
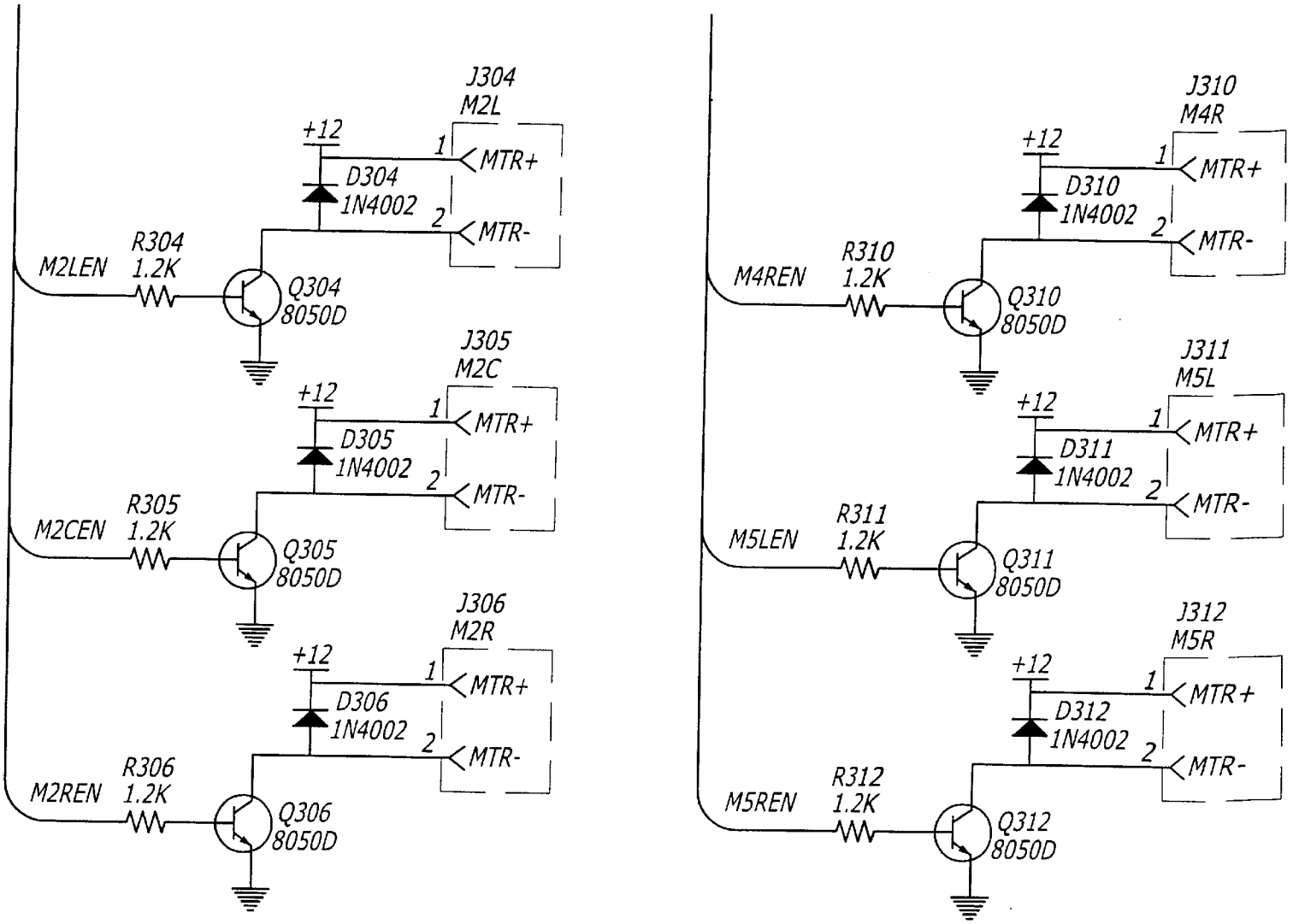
Figure 6:
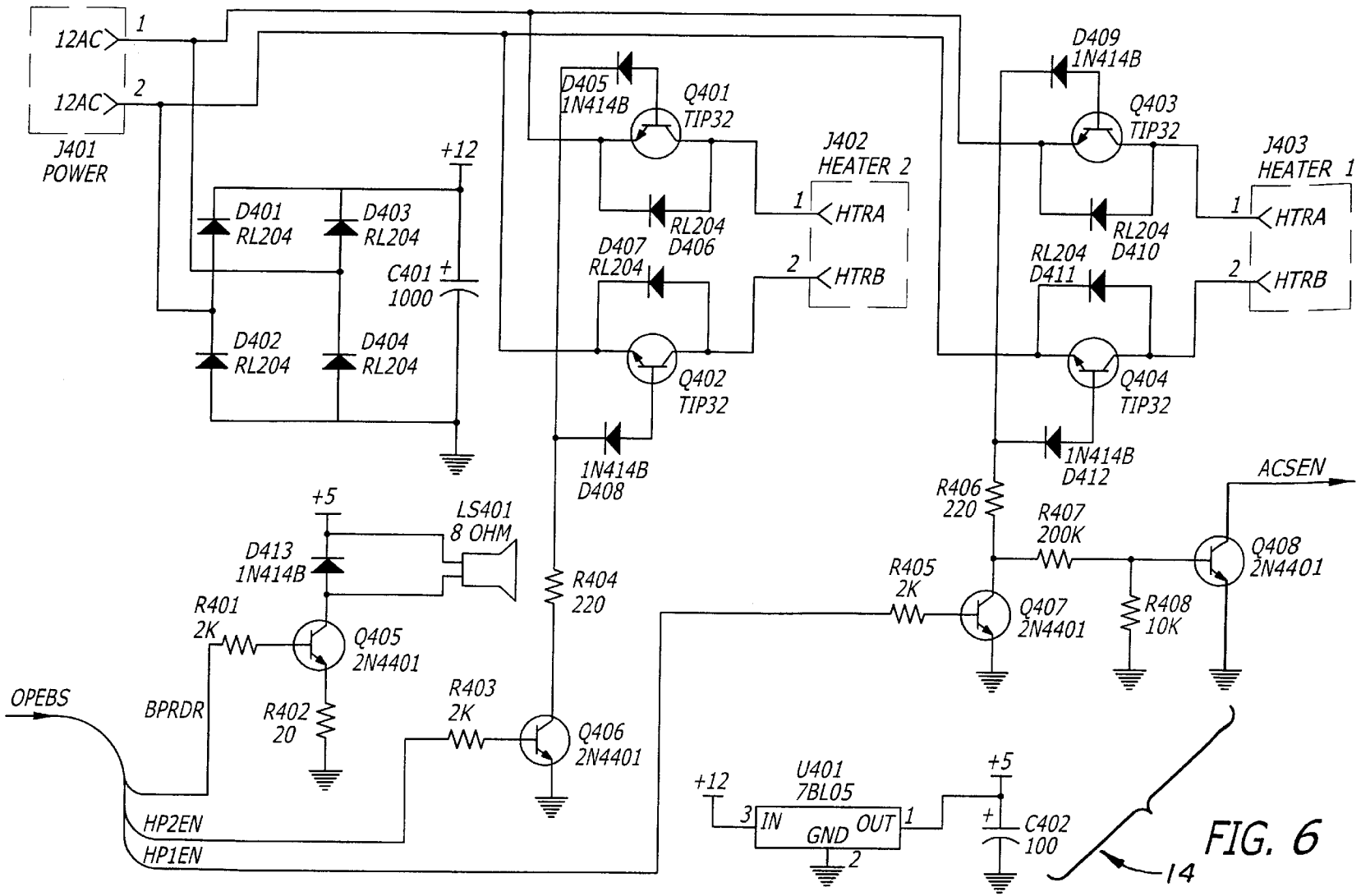
FIG. 6 is a schematic diagram of a further receiver unit portion of the system of FIG. 1.

The micro controller unit 14 includes a microprocessor 42, that like the microprocessor 36 has program and variable memory, the microprocessor 42 being interfaced to the device code switch 41 (See FIG. 4.), and to the motors 26 through respective drivers 44 (FIG. 5). As shown in FIG. 6, the microprocessor 42 is also interfaced to the heaters 27A and 27B, and to a speaker 46, the speaker 46 being driven in a conventional manner to produce an audible, pleasant sounding beep in the range of 1 KHz rep rate, at a selectable volume level, each time any key is pressed on the wand. Hold-down type keys such as Intensity and Speed have repeated beeps corresponding to each step change of the controlled function. The speaker 46 can be implemented as a PCB-mounted device, being included on a suitable circuit card with other components of the micro controller unit 14, the unit 14 being mounted inside recliner chair 16, under the cushion 28.

Three or more separate device codes are implemented in each of the wand 30 and the micro controller unit 14 for providing reliable communication between the wand 30 and the chair 16 when other such devices are nearby. This can be implemented by a three position switch on the end of a cord between the wand 30 and the chair 16, which cord can be positioned on the chair frame structure where it can be reached by a user, for example by tipping the chair 16 over. A corresponding three position switch on the wand 30 can be reached when a battery cover is removed. In an exemplary embodiment and as shown in the drawings, the wand 30 has the device code switch 40 (three independently settable contact closures) and the micro controller unit 14 has a corresponding three-element decoder switch 41. In a further alternative, the wand ID code can be programmed with a sequence of button pressings, which will be maintained until the batteries are removed.

A suitable power supply for the wand 30 is a pair of 1.5V dry cells, such as ordinary AAA batteries. A power circuit of the wand 30 provides protection from reverse polarity installation of batteries, to prevent any damage to the wand.

Operational Modes & Function Keys

Figure 2:
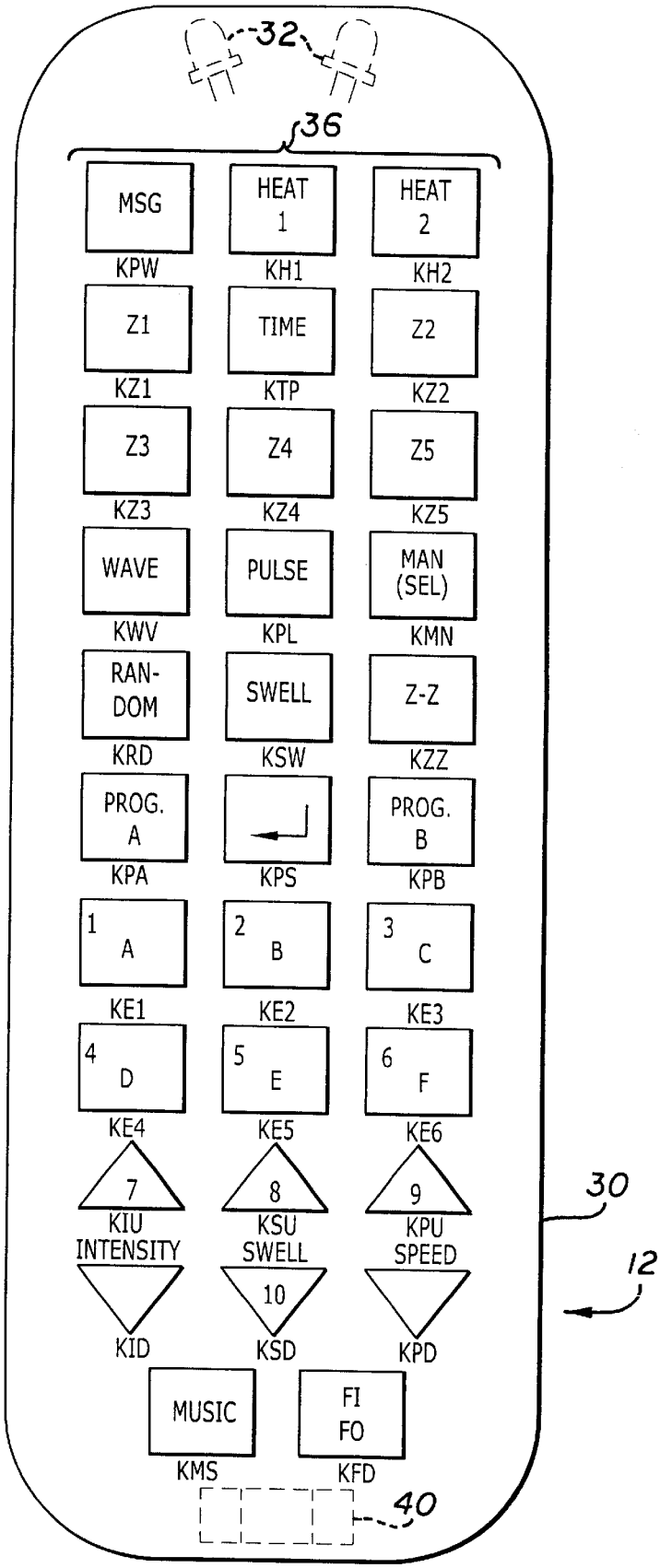
FIG. 2 is a front view of a remote controller unit of the system of FIG. 1.

Referring to FIG. 2, and source code listings of Appendix A, several operation modes of the system are described below. In FIG. 2, key designations corresponding to listing codes are given below the respective keys *with certain features described in Appendix B.

1. MASSAGE—This key turns massaging on and off (alternate action key). If the system 10 remains powered since the last turn-off, operation commences in the last selected mode, intensity, speed, etc. that prevailed at time of the last turn off. If the system is turned on the first time after power is applied using the Massage key, the system is activated in an arbitrary manner, such as Zone 1 of the chair 16, at medium intensity in SELECT mode, time set for fifteen minutes. Further, other function keys (Z1 through Z5 and S/E A through F) can be implemented to activate the system 10 in that function.

2. HEAT 1—A first press of the key turns heat ON HIGH; a second press switches to LOW heat, and a third press turns heat pad off. User feedback for HI and LO heat is via sound, a short beep for LO, a longer beep for HI (beep pitch about 1 KHz). The heaters 27 stay on in low heat until a suitable operating temperature is reached, and they can then cycle to maintain the low heat temperature. HEAT 1 can have its own timer set to 30 minutes. During a time period, switching to HI or LO heat will not reset the timer, but turning heat off will reset timer at next turn on.

3. HEAT 2—A first press of the key turns heat ON HIGH; a second press switches to LOW heat, and a third press turns the heater 27A off. User feedback for HI and LO heat is via sound, a short beep for LO, and a longer beep for HI (beep pitch about 1 KHz). Operation in low heat, and timer operation is as described above.

4. TIME (massage)—Alternate presses of this key change the timer interval between 15 and 30 minutes. Sounds as described above for the HI–LO heat identify time period. Operation of the Time key resets time period.

5. Z1 through Z5 (Zones)—The first press of one of these keys activates that zone of the chair 16, a second press turns it off. If the system is in one of the WAVE, PULSE, or SELECT (W,P,S) modes, the system remains in that mode regardless of zone pressing action. If the system was in any other functional mode (RANDOM, Z—Z, S/E, etc.) pressing any zone key will turn that zone on in SELECT mode.

6. WAVE—A press of this key turns this mode ON. Multiple Presses do not alter the mode state. Cycles any activated zones down and up, at rates determined by SPEED keys setting. WAVE mode is turned off by pressing any other mode key.

7. PULSE—A first press of this key simultaneously pulses any zones turned on at SPEED key rate with 50/50 duty cycle. A second press changes the duty cycle to an unsymmetrical setting, such as 10/90 or 20/80. The duty cycle setting alternates on successive presses. This mode is terminated as described above for the WAVE mode.

8. SELECT (manual)—operates any activated zones at a steady intensity. The intensity adjusts automatically to stay within rated transformer power as additional motors and/or heating pads are activated. This mode is also terminated as described above for the WAVE mode.

9. RANDOM—randomly turns on one motor of the ten left and right motors in all the zones, changing motors at a rate defined by the SPEED keys. This mode is also terminated as described above for the WAVE mode.

10. SWELL—This key, operative in SELECT and WAVE modes, activates and deactivates the SWELL mode (alternate action key). The intensity is varied from the lowest level to that set by the INTENSITY keys, at a rate determined by the setting of the SWELL SPEED keys (KSU/KSD). Options include choice of the intensity change waveform, which can be sinusoidal or triangular, for example.

11. ZIG-ZAG—This key sequentially activates the motors of zones Z1L, Z2R, Z3L, Z4R, Z5R, Z4L, Z3R, Z2L, Z1R, and Z1L, at a rate set by the SPEED keys. This mode is terminated as described above for the WAVE mode.

12. PROGRAM A—The Program A key allows setting a sequence of up to 10 steps of motor activation, each step being in a selected zone (2 motors on at the same time) or a selected one 1 of 10 numbered motors (1 motor on at a time). Zone and number positions can be mixed in any desired order. Intensity can be set for each motor or zone programmed. During program execution intensity keys can be inactive, or they can adust all positions in relative ratio to their initial programed settings. An example programming sequence is as follows:

(a) Press PROG A key;

(b) Press a zone or numbered motor key. Motor(s) come on at medium intensity. Second press of same motor or zone will turn it off allowing user to accept or delete the last choice;

(c) Adjust intensity to desired level. If no intensity change is wanted press next zone or motor key to be programmed;

(d) The maximum number of program steps is 10. After the tenth setting, pressing any next key will sound a beep to inform the user that the program is full;

(e) Press the Enter key (←) to store the program and begin execution. ← can be pressed after any number of motor settings from 1 to 10;

(f) Pressing any other function key (zone, mode, S/E) stops the program execution but retains it in memory until power is removed. No cancel function is required; program can be changed as desired by reprogramming; and (g) The program can be recalled by pressing The Program A key again, followed by ←.

13. PROGRAM B—This key operates as described above for Program A. The Program A and Program B keys operate independently, thus providing separate programs for two different users (his/hers, etc.).

14. ENTER←—This key is used with the Program A and Program B keys as described above.

15. A–F (Special Effects, or S/E)—The Special Effects mode alternately activates preset combinations of the six motors in zones 1 and 2. If the system is operating in any mode (Wave, Pulse, Manual, Random, Swell, Zig-Zag, Program A, or Program B), and an S/E key is pressed, the previous mode setting will be retained in memory and it can be recalled by pressing the respective MODE key. If any of keys Z1 through Z5 is pressed after the S/E mode, that zone will be activated in SELECT mode, and any previous zone programs settings are canceled. Specific exemplary combinations of the Special Effects activation zones are as follows:

A—Z1L and Z2R alternating with Z1R and Z2L;

B—Z1L and Z1R alternating with Z1C;

C—Z1L and Z2L alternating with Z1R and Z2R;

D—Z1L and Z1R alternating with Z2C;

E—Z2L and Z2R alternating with Z2C; and

F—Z2L and Z2R alternating with Z1C.

16. INTENSITY UP/DOWN—These keys vary the intensity smoothly without apparent steps, covering the total range in approximately 5 seconds, for as long as either key is held down. The intensity range provides a motor speed range equivalent to the application of from approximately 8VDC to approximately 12VDC across activated ones of the motors. There is no interruption of existing motor activity when either key is pressed; only the changing intensity is experienced.

17. SWELL UP/DOWN—These keys alter the rate of change in the Swell mode, smoothly and without apparent steps. In an exemplary implementation, the speed ranges from approximately 1 cycle (up and down intensity) per second to approximately 1 cycle per 10 seconds.

18. SPEED UP/DOWN—These keys alter the rate of cycling in any sequencing or pulsing mode, smoothly and without apparent steps. In an exemplary implementation, the speed ranges from approximately 3½ seconds dwell per position to three positions per second.

19. FI/FO—(fade in/fade out)—This key provides an overlapping intensity change in transitions from activation of one motor, zone or special effects state, etc., to the next. This is an alternate action key, alternate presses restoring instantaneous transitions. The overlap period is preferably only that which is sufficient to give an impression of smooth transitions.

20. MUSIC—This key switches intensity control to a function of the integrated amplitude of the audio signal from a music or other sound source. When no input signal is present, the motors do not turn or they turn slowly enough not to be felt as a massage action. The motors are operated at maximum intensity when maximum audio signals are present. An automatic level control (ALC) having a slow time constant can be provided for maintaining a relatively constant signal level range into the remainder of the massage system. This is an alternate action key, alternate presses restoring instantaneous transitions. In the MUSIC mode several options are possible; for example:

(a) The INTENSITY keys are inoperative, or they operate to control maximum massaging intensity levels to be experienced by a user; and (b) The music effects can be operative during all other massage functions, or they can be confined to certain functions only, such as zone action in SELECT mode, thereby limiting the number of activated motors for assuring that a full intensity range can be experienced.

In an exemplary embodiment of the present invention as implemented in the program of Appendix A, the wand transmits individual keystrokes to a main control processor in the chair. The micro controller unit 14, as implemented in the program of Appendix B, deciphers and interprets the keystrokes. Audible and vibration forms of feedback are provided for indicating current operating states of the controller. Alternatively, the microprocessor 36 of the wand 30 can be programmed for monitoring the entire operating state of the system 10, including the sequences saved using the Program A and Program B keys, and the micro controller unit 14 of the chair 16 would be programmed to execute the currently selected program and/or mode settings.

The wand 30 can transmit a program update to the chair 16 whenever a user key press results in a change in the current program. Some key pressing would be local to the wand 30 and would not involve a program update. The wand 30 can also incorporate its own beeper system to accommodate the aforementioned cases.

The transmission to the chair is preferably the complete current program, not just the changes. In this manner, if the control unit 14 misses a transmission, the next transmission would fill in any missed changes.

A data transmission consists of three or more identical packets, each packet containing a header, a device code, a sequence number, the program data and an error detecting code. The micro controller unit 14 processes each packet as follows:

(a) Validate the packet using the error detecting code. If an error is detected, ignore the packet;

(b) Compare the device code as transmitted from the wand 30 with the chair's device code as set by the selector switch 41. If the codes are not the same, ignore the packet;

(c) Compare the sequence number to that of the last valid packet. If they are the same, ignore the packet;

(d) If the packet is acceptable, save the sequence number for comparison to future packets and then output sequence number for comparison to future packets and then output a beep. The type of beep can be specified in the packet data; and (e) Update the current massage program from the packet data.

Alternatively, error detecting and correcting codes can be used to allow the chair micro controller to reconstruct certain levels of erroneous packet data. The codes are similar to those used in modern hard disk drives and long range satellite communication.

As such, the chair always follows the program stored in the wand 30 even with occasional reception errors. A dedicated key can be utilized on the wand to retransmit the current program in the event of substantial infrared interference or when the chair 16 is in a questionable mode.

The wand 30 can include means for visual feedback indicating the current state of the system. Examples of such feedback systems can include: (a) status LEDs driven to desired intensity level under the control of the microprocessor 36 in the wand 30. The microprocessor can deactivate the LEDs after several seconds of inactivity and automatically restore their state whenever a new key is pressed; or (b) LCD with icons to graphically illustrate the current chair program and special local operating modes such as programming mode.

Audio input can be connected directly to the chair micro controller unit 14 and can be enabled and controlled via the wand 30. The current and store programs in the wand 30 can be retained when there is no power by using a serial EEPROM. The EEPROM can also be used to store the device codes and allow device code entry from the keys thereby eliminating the need for selector switches.

Although the present invention has been described versions thereof, other versions are possible. For example, the cushion 28 can have the micro control unit 14 packaged therewith for use as a stand-alone massaging device (apart from the chair frame 17). Therefore, the spirit and scope of the appended claims should not necessarily be limited to the description of the preferred versions contained herein.

What is claimed is:

1. A remote controlled massage device for use in a room having a ceiling, comprising:

(a) a remote control unit comprising:
- (i) a housing;
- (ii) a microprocessor in the housing;
- (iii) a keypad for communicating user input to the microprocessor, the microprocessor being configured and programmed for generating output data in response to the user input; and
- (iv) a transmitter connected to the microprocessor and having a transducer for producing radiation signals corresponding to the output data, including radiation signals being reflectable from the ceiling;

(b) a massage unit for contacting a user's body and comprising:
- (i) a cushion;
- (ii) electrically powered vibrator elements in the cushion;
- (iii) a detector supportable in an upwardly directed orientation relative to the cushion for receiving radiation signals including signals from the transmitter being reflected from the ceiling; and
- (iv) a micro controller system electrically connected to the vibrator elements for driving same in a plurality of modes having variant power levels in response to the detector, wherein the radiation signals are transmitted in plural identical packets, each packet having a header, a sequence number, program data, and an error code, the micro controller system being programmed for validating received packets using the error code and ignoring packets for which errors are detected.

2. The device of claim 1, wherein subsequent sets of the identical packets have different sequence numbers, the micro controller system being further programmed for storing the sequence number of a last-received valid packet, comparing the stored sequence number with a next-received valid packet, and ignoring next-received valid packets having sequence numbers matching the stored sequence number.

3. A remote controlled massage device for use in a room having a ceiling, comprising:

(a) a remote control unit comprising:
- (i) a housing;
- (ii) a microprocessor in the housing;
- (iii) a keypad for communicating user input to the microprocessor, the microprocessor being configured and programmed for generating output data in response to the user input; and
- (iv) a transmitter connected to the microprocessor and having a transducer for producing radiation signals corresponding to the output data, including radiation signals being reflectable from the ceiling;

(b) a massage unit for contacting a user's body and comprising:
- (i) a cushion;
- (ii) electrically powered vibrator elements in the cushion;
- (iii) a detector supportable in an upwardly directed orientation relative to the cushion for receiving radiation signals including signals from the transmitter being reflected from the ceiling; and
- (iv) a micro controller system electrically connected to the vibrator elements for driving same in a plurality of modes having variant power levels in response to the detector, wherein the radiation signals are transmitted in packets, each packet having a header, a device code, and program data, the micro controller system being programmed for validating received packets by comparing the device code with a settable massager code of the massage unit and ignoring packets for which the device code fails to match the massager code.

4. A remote controlled massage device for use in a room having a ceiling, comprising:

(a) a remote control unit comprising:
- (i) a housing;
- (ii) a microprocessor in the housing;
- (iii) a keypad for communicating user input to the microprocessor, the microprocessor being configured and programmed for generating output data in response to the user input, at least a portion of the output data directly corresponding to individual keystrokes of the keypad, the individual keystrokes including keystrokes defining activation of particular vibrator elements; keystrokes defining operation in particular time-variant power level sequences; keystrokes defining relative vibration intensity; and keystrokes defining relative speed of advancing through the time-variant power sequences; and
- (iv) a transmitter connected to the microprocessor and having a transducer for producing radiation signals corresponding to the output data, including radiation signals being reflectable from the ceiling, the radiation signals being transmitted in plural identical packets, each packet having a header, a sequence number, a device code program data, and an error code, subsequent sets of the identical packets having different sequence numbers;

(b) a massage unit for contacting a user's body and comprising:
- (i) a cushion;
- (ii) electrically powered vibrator elements in the cushion;
- (iii) a detector supportable in an upwardly directed orientation relative to the cushion for receiving radiation signals including signals from the transmitter being reflected from the ceiling; and
- (iv) a micro controller system electrically connected to the vibrator elements for driving same in a plurality of modes having variant power levels in response to the detector, the micro controller system being programmed for validating received packets using the error code and ignoring packets for which errors are detected, comparing the device code with a settable massager code of the massage unit and ignoring packets for which the device code fails to match the massager code, storing the sequence number of a last-received valid packet, comparing the stored sequence number with a next-received valid packet, and ignoring the next-received valid packets having sequence numbers matching the stored sequence number.

* * * * *

UNITED STATES PATENT AND TRADEMARK OFFICE

CERTIFICATE OF CORRECTION

PATENT NO. : 6,290,661 B1 
DATED : September 18, 2001
INVENTOR(S) : Stanley Cutler, Alton B. Otis, Jr. and Taylor Chau It is certified that error appears in the above-identified patent and that said Letters Patent is hereby corrected as shown below:

Column 1,
Line 11, in "Reference to Related Application," change "Ser. No. 08/901,374, filed Jul. 28, 1996," to read -- Ser. No. 08/901,374, filed Jul. 28, 1997 --.

Signed and Sealed this

First Day of October, 2002

*Attest:*

*Attesting Officer*

JAMES E. ROGAN
*Director of the United States Patent and Trademark Office*